US005607291A

United States Patent [19]

Morita et al.

[11] Patent Number: 5,607,291

[45] Date of Patent: Mar. 4, 1997

[54] CLOSED COMPRESSOR

[75] Inventors: Keisuke Morita, Otsu; Hiroshi Matsunaga; Shigeru Muramatsu, both of Kusatsu; Shinji Fujiwara, Otsu, all of Japan

[73] Assignee: Matsushita Electric Industrial Co., Ltd., Osaka-fu, Japan

[21] Appl. No.: 359,637

[22] Filed: Dec. 20, 1994

[30] Foreign Application Priority Data

Dec. 21, 1993 [JP] Japan ..... 5-321649

[51] Int. Cl.[6] ..... F04B 15/08

[52] U.S. Cl. ..... 417/410.1; 417/902; 417/DIG. 1

[58] Field of Search ..... 417/902, DIG. 1, 417/410.1

[56] References Cited

U.S. PATENT DOCUMENTS

| | | | |
|---|---|---|---|
| 2,018,917 | 10/1935 | Lipman | 417/902 X |
| 2,199,415 | 5/1940 | Philipp | 417/902 X |
| 2,285,754 | 6/1942 | Money | 417/902 X |
| 4,606,706 | 8/1986 | Utter | 417/902 X |
| 4,881,879 | 11/1989 | Ortiz | 417/902 X |
| 4,988,269 | 1/1991 | Blass | 417/902 X |

*Primary Examiner*—Richard E. Gluck
*Attorney, Agent, or Firm*—Wenderoth, Lind & Ponack

[57] ABSTRACT

A closed compressor includes a closed vessel made of steel and a vapor-liquid separator connected to the closed vessel. The closed vessel and the vapor-liquid separator have a discharge steel pipe and a suction steel pipe, respectively, each of which has a hexagonal portion and a threaded portion for connection with an aluminum pipe. The closed compressor of this construction is suited for use in an automotive air conditioner.

4 Claims, 3 Drawing Sheets

CLOSED COMPRESSOR

BACKGROUND OF THE INVENTION

1. Field of the Invention

The present invention relates to a closed compressor which is to be connected to aluminum pipes in a refrigerator or an air conditioner.

2. Description of Related Art

Air conditioners incorporated into automotive vehicles generally employ R-12 refrigerant and an open compressor. Because such air conditioners are required to be lightweight, aluminum is generally used for a shell of the compressor and connecting pipes.

Nowadays, however, automotive vehicles require a closed compressor for the purpose of avoiding atmospheric pollution by the refrigerant.

FIG. 3 depicts a typical closed compressor currently used in a room air conditioner.

The compressor shown in FIG. 3 has a closed vessel 104 made up of a cylindrical shell 101, an upper shell 102, and a lower shell 103, all of which are made of steel. The upper and lower shells 102 and 103 are seam-welded to the cylindrical shell 101 to meet hermetical sealing requirements and to provide resistance to pressure. The closed vessel 104 accommodates an electric motor 105 and a compression element assembly 106 driven by the electric motor 105.

Refrigerant compressed by the compression element assembly 106 is discharged into the closed vessel 104, which has sufficient resistance to the pressure of the discharged refrigerant because it is made of steel.

The cylindrical steel shell 101 has an external suction copper pipe 107 joined thereto by silver-brazing. The suction pipe 107 is joined to a vapor-liquid separator 108 via a connecting pipe 110. The vapor-liquid separator 108 is made of iron or copper and has a suction copper pipe 109 through which the refrigerant is introduced thereinto. The refrigerant which has passed through the vapor-liquid separator 108 is introduced into the closed vessel 104 through the connecting pipe 110, which is joined to the vapor-liquid separator 108 by silver-brazing or copper-brazing.

The closed compressor of the above-described construction is incorporated into the room air conditioner and is connected to a heat exchanger (not shown) via connecting pipes 111*a* and 111*b*. Because the connecting pipes 111*a* and 111*b* are generally made of copper, they are joined to the suction pipe 109 and to a discharge pipe 112 secured to the upper shell 102, respectively, by copper-brazing or the like.

However, the following problems are encountered in utilizing the closed compressor in an automotive air conditioner.

In order to reduce the weight of the automotive vehicle, the compressor is connected to the heat exchanger generally by lightweight aluminum pipes in a comparatively small engine room. Accordingly, brazing is considerably difficult which is employed for pipe connections in the room air conditioner, as discussed above.

Furthermore, if copper pipes are employed as connecting pipes joined to the compressor, it is necessary to connect them with aluminum pipes leading to the heat exchanger. Because ionization tendency greatly differs between copper and aluminum, it is likely that electrolytic corrosion would occur.

SUMMARY OF THE INVENTION

The present invention has been developed to overcome the above-described disadvantages.

It is accordingly an objective of the present invention to provide a closed lightweight compressor which has sufficient resistance to pressure and facilitates pipework in a limited space.

Another objective of the present invention is to provide the closed compressor of the above-described type which can be incorporated in an automotive air conditioner.

In accomplishing the above and other objectives, the closed compressor according to the present invention comprises a closed vessel made of steel and having a discharge steel pipe joined thereto, an electric motor and a compression element assembly both accommodated in the closed vessel, and a vapor-liquid separator connected to the closed vessel and having a suction steel pipe joined thereto. Each of the discharge steel pipe and the suction steel pipe has a hexagonal portion and a threaded portion for connection with an aluminum pipe.

In the above-described construction, because the closed vessel is made of steel, it has sufficient resistance to pressure. Where the closed compressor is utilized in an automotive air conditioner, the closed vessel and the vapor-liquid separator are connected to a heat exchanger via lightweight aluminum pipes. Such a connection can be accomplished in a comparatively small engine room merely by tightening nuts mounted on flared free ends of the aluminum pipes with respect to associated threaded portions. Although the steel pipes are held in contact with the flared ends of the aluminum pipes to provide a sufficient seal therebetween, no substantial electrolytic corrosion would occur because the two materials do not greatly differ in ionization tendency.

In another form of the present invention, the closed compressor comprises a closed vessel and a vapor-liquid separator having a suction steel pipe and an outlet copper pipe both joined thereto, with the outlet copper pipe connected to the closed vessel. The suction steel pipe has a hexagonal portion and a threaded portion for connection with an aluminum pipe.

In a further form of the present invention, the closed compressor is utilized in an automotive air conditioner and comprises a closed vessel made of steel and having a discharge steel pipe joined thereto, an electric motor and a compression element assembly both accommodated in the closed vessel, and a vapor-liquid separator having a suction steel pipe and an outlet copper pipe both joined thereto, with the outlet copper pipe connected to the closed vessel. Each of the discharge steel pipe and the suction steel pipe has a hexagonal portion and a threaded portion for connection with an aluminum pipe.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
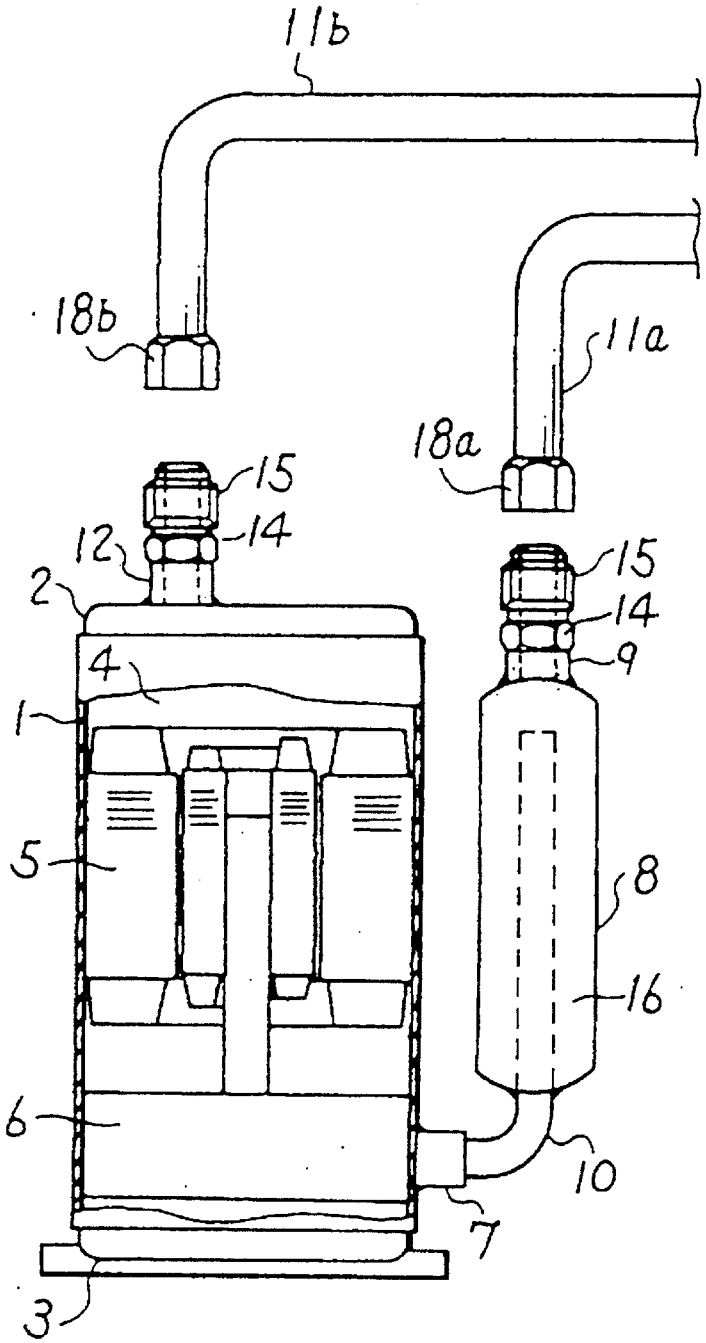
FIG. 1 is a schematic elevational view, partly in section, of a closed compressor according to the present invention.

Referring now to the drawings, there is shown in FIG. 1 a closed compressor according to the present invention.

The compressor shown in FIG. 1 has a closed vessel 4 made up of a cylindrical shell 1, an upper shell 2, and a lower shell 3, all of which are made of steel. The upper and lower shells 2 and 3 are seam-welded to the cylindrical shell 1. The closed vessel 4 accommodates an electric motor 5 and a compression element assembly 6.

The electric motor 5 drives the compression element assembly 6 to compress refrigerant, which is in turn discharged into the closed vessel 4. Because the closed vessel 4 is made of steel, it has sufficient resistance to the pressure of the discharged refrigerant.

Figure 2:
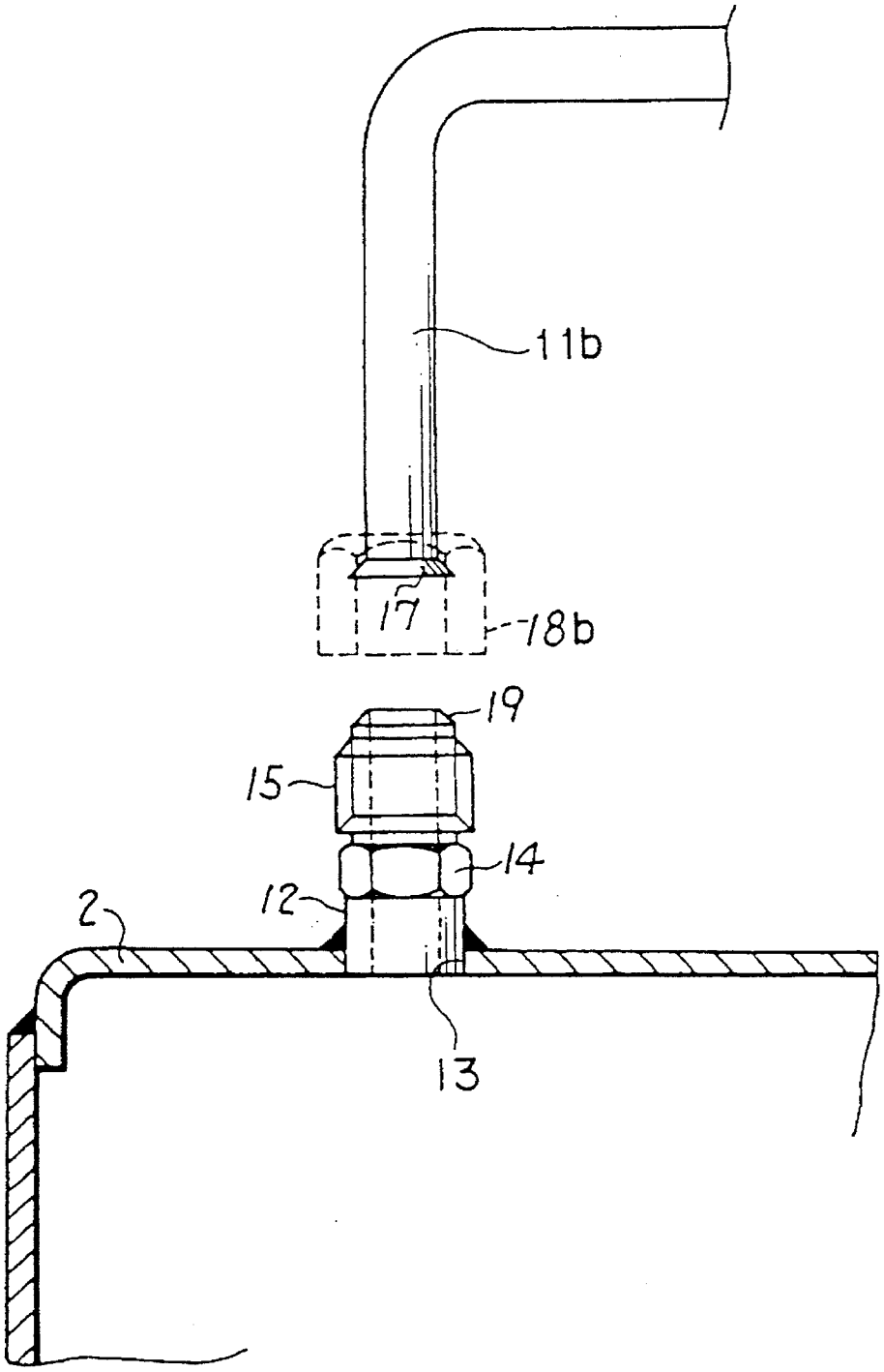
FIG. 2 is an elevational view, on an enlarged scale, of connectors required to connect the compressor with another device in an air conditioner incorporated in an automotive vehicle.
Figure 3:
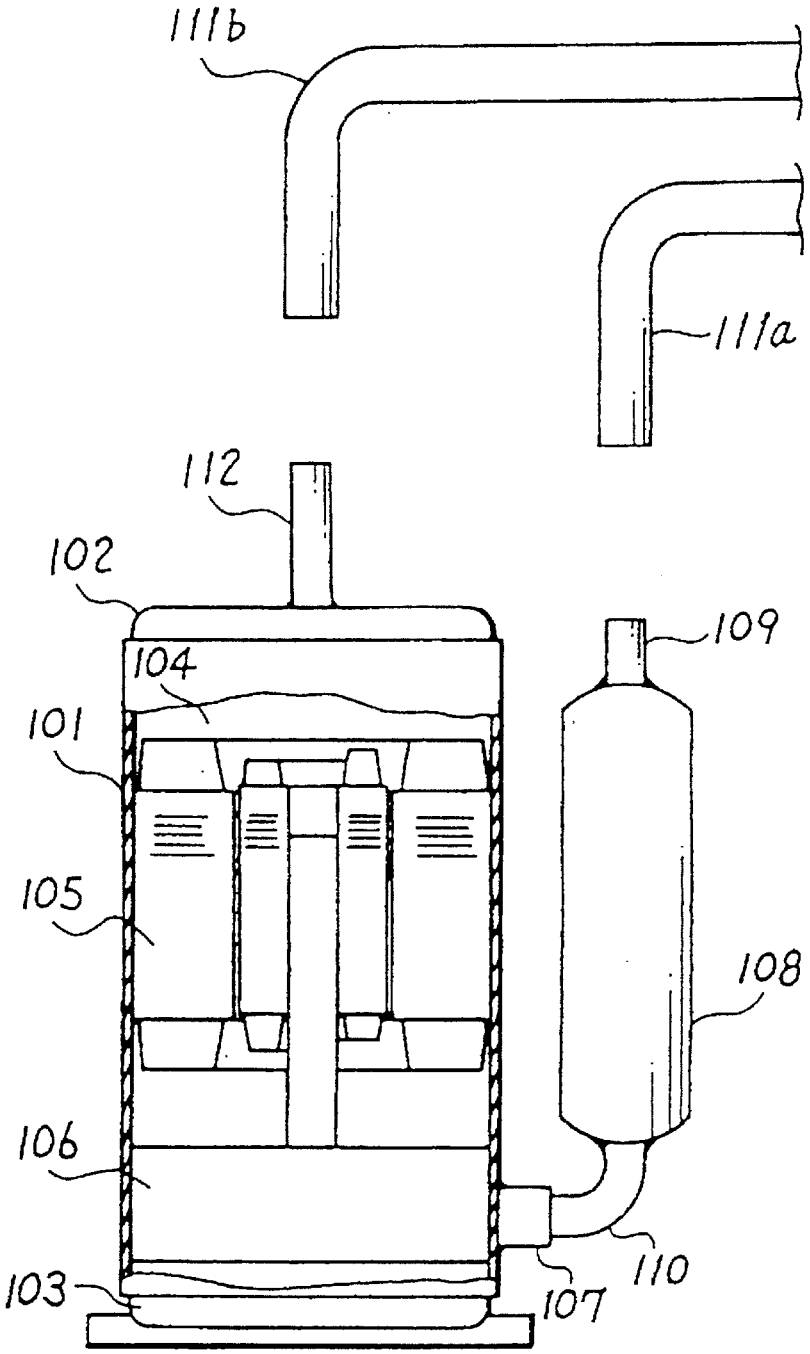
Fig. 3 PRIOR ART
FIG. 3 is a view similar to FIG. 1, but indicating a conventional closed compressor.

As shown in FIG. 2, the upper shell 2 has an opening 13 defined therein, in which a lower end of a cylindrical steel pipe 12, employed to discharge the refrigerant therefrom, is inserted and joined to the upper shell 2 by silver-brazing. This pipe 12 (hereinafter referred to as a discharge pipe) has a hexagonal portion 14 at an intermediate portion thereof, a threaded portion 15 above the hexagonal portion 14, and a tapered top 19. Each of the hexagonal portion 14 and the threaded portion 15 is integrally formed with or otherwise rigidly secured to the discharge pipe 12.

A vapor-liquid separator 8, disposed generally parallel to the compressor, has a separator body 16 made of iron or copper and a cylindrical steel pipe 9 joined thereto by silver-brazing at an upper portion thereof. This pipe 9 is employed to introduce the refrigerant into the vapor-liquid separator 8 therethrough and is of the same construction as the discharge pipe 12. The pipe 9 (hereinafter referred to as a suction pipe) is joined to the separator body 16 by silver-brazing.

The vapor-liquid separator 8 also has an outlet copper pipe 10 extending through a lower wall thereof and joined thereto by silver-brazing. The outlet pipe 10 extends upwardly inside the vapor-liquid separator 8 to form a liquid-refrigerant sump therearound. The outlet pipe 10 is connected at its lower end to the cylindrical shell 1 via a suction copper pipe 7. The outlet pipe 10 is joined to the suction pipe 7 by copper-brazing, while the suction pipe 7 is joined to the cylindrical shell 1 by silver-brazing.

The vapor-liquid separator 8 is made in a process different from that of making the compressor body. If the separator body 16 is made of iron, the separator body 16, the suction pipe 9, and the outlet pipe 10 can be readily assembled into the vapor-liquid separator 8 in a reducing furnace or the like.

Furthermore, because the suction pipe 7 and the outlet pipe 10 are both made of copper, they can be joined to each other in a final assembling process for the compressor using a torch, thus facilitating assemblage of the vapor-liquid separator 8.

When the closed compressor of the above-described construction is incorporated into an automotive vehicle, it is connected with a heat exchanger (not shown) via aluminum pipes 11*a* and 11*b* to complete an air conditioner.

As shown in FIG. 2, the aluminum pipe 11*b* has a flared free end 17 and a nut 18*b* mounted on the flared end 17. Likewise, the aluminum pipe 11*a* also has a flared free end 17 and a nut 18*a* mounted on the flared end 17.

The aluminum pipes 11*a* and 11*b* are connected to the suction pipe 9 and the discharge pipe 12, respectively, by tightening the nuts 18*a* and 18*b* of the former to associated threaded portions 15 of the latter. By so doing, the tapered tops 19 of the pipes 9 and 12 adhere to associated flared ends 17 of the aluminum pipes 11*a* and 11*b*, thereby appropriately sealing therebetween. During tightening, the hexagonal portion 14 of each of the pipes 9 and 12 is held by any suitable means such as, for example, a spanner so that no torque may be transmitted to the brazed joint between the separator body 16 and the suction pipe 9 or between the upper shell 2 and the discharge pipe 12, thereby preventing breakage of the brazed joint.

Although steel and aluminum are held in contact with each other at the sealed portions, no substantial electrolytic corrosion would occur because the two materials do not greatly differ in ionization tendency. If the threaded portion 15 is made of copper, electrolytic corrosion would occur at the contact portion between copper and aluminum due to a large difference in ionization tendency, thus resulting in an accidental leakage of the refrigerant gas.

Although the above pipework is generally carried out in a comparatively small engine room during assemblage of the automotive vehicle, tightening of the nuts can be readily done even in a limited space and, also, can be automated.

As is clear from the above, where the closed compressor of the present invention is incorporated in the automotive air conditioner, the aluminum pipes leading to the heat exchanger can be readily connected to associated pipes of the closed compressor by merely tightening the nuts mounted on the free ends of the aluminum pipes, thus facilitating assemblage and realizing a reliable air conditioner free from electrolytic corrosion.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An automotive air conditioner arrangement comprising a closed compressor, and an aluminum pipe for use in connecting said closed compressor to a heat exchanger, said closed compressor comprising:

a closed vessel made of steel;

an electric motor accommodated in said closed vessel;

a compression element assembly accommodated in said closed vessel and driven by said electric motor; and a vapor-liquid separator disposed outside said closed vessel and having a generally cylindrical suction steel pipe and an outlet copper pipe both joined thereto, said suction steel pipe having a threaded portion for connection with said aluminum pipe, said outlet copper pipe being connected to said closed vessel, and a hexagonal portion being provided on said suction steel pipe.

2. The automotive air conditioner arrangement according to claim 1, wherein said closed vessel has a generally cylindrical discharge steel pipe joined thereto, said discharge steel pipe having a threaded portion adapted for connection with an aluminum pipe, said suction steel pipe and said discharge steel pipe extending generally parallel to each other, and a hexagonal portion being provided on said discharge steel pipe.

3. The closed compressor according to claim 2, wherein said hexagonal portions are rigidly and non-rotatably secured to said suction steel pipe and said discharge steel pipe, respectively.

4. The closed compressor according to claim 1, wherein said hexagonal portion provided on said suction steel pipe is rigidly and non-rotatably secured to said suction steel pipe.

* * * * *